US006238521B1

(12) United States Patent
Shing et al.

(10) Patent No.: US 6,238,521 B1
(45) Date of Patent: May 29, 2001

(54) USE OF DIALLYLDIMETHYLAMMONIUM CHLORIDE ACRYLAMIDE DISPERSION COPOLYMER IN A PAPERMAKING PROCESS

(75) Inventors: Jane B. Wong Shing, Aurora; Chidambaram Maltesh; Ramasubramanyam Nagarajan, both of Naperville, all of IL (US)

(73) Assignee: Nalco Chemical Company, Naperville, IL (US)

( * ) Notice: Subject to any disclaimer, the term of this patent is extended or adjusted under 35 U.S.C. 154(b) by 0 days.

(21) Appl. No.: 09/316,372

(22) Filed: May 21, 1999

Related U.S. Application Data

(63) Continuation-in-part of application No. 09/172,587, filed on Oct. 14, 1998, now abandoned, which is a continuation-in-part of application No. 08/845,795, filed on Apr. 25, 1997, now abandoned, which is a continuation of application No. 08/641,671, filed on May 1, 1996, now abandoned.

(51) Int. Cl.[7] ..... D21H 21/10

(52) U.S. Cl. ..... 162/164.1; 162/158; 162/164.3; 162/164.6; 162/168.1; 162/168.2; 162/168.3; 162/181.6; 162/181.8; 162/175; 162/183

(58) Field of Search ..... 162/168.1, 175, 162/158, 164.1, 168.3, 164.3, 181.6, 164.6, 181.8, 183, 168.2

(56) References Cited

U.S. PATENT DOCUMENTS

| | | |
|---|---|---|
| 4,388,150 | 6/1983 | Sunden et al. . |
| 4,753,710 | 6/1988 | Langley et al. . |
| 4,913,775 | 4/1990 | Langley et al. . |
| 4,929,655 | 5/1990 | Takeda et al. . |
| 5,006,590 | 4/1991 | Takeda et al. . |
| 5,098,520 | 3/1992 | Begala . |
| 5,178,730 | 1/1993 | Bixler et al. . |
| 5,185,062 | 2/1993 | Begala . |

FOREIGN PATENT DOCUMENTS

| | | |
|---|---|---|
| 2180404 | 1/1997 | (CA) . |
| 202780 | 11/1986 | (EP) . |
| 277728 | 8/1988 | (EP) . |
| 0805234 | 11/1997 | (EP) . |
| 57-77399 | 5/1982 | (JP) . |
| 59-137600 | 8/1984 | (JP) . |
| 61-6397 | 1/1986 | (JP) . |
| WO 97/18351 | 5/1997 | (WO) . |

*Primary Examiner*—Peter Chin
(74) *Attorney, Agent, or Firm*—Margaret M. Brumm; Thomas M. Breininger

(57) ABSTRACT

A papermaking process consisting essentially of:

forming an aqueous cellulosic papermaking slurry;

adding to the slurry certain additives, with said certain additives selected from the group including: coagulants; sizing agents; and mineral fillers;

draining the slurry to form a sheet; and drying the sheet to form a paper sheet;

the improvement comprising adding to the slurry, prior to it being drained; an effective amount of a cationic dispersion polymer; which cationic dispersion polymer is a copolymer comprising about 30 mole % diallyldimethylammonium chloride (DADMAC) and about 70 mole % acrylamide (AcAm); and adding to the slurry, either before or after said cationic dispersion polymer is added and the slurry is drained, a microparticle selected from the group consisting of
a) copolymers of acrylic acid and acrylamide;
b) bentonite; and
c) dispersed silica;

with the proviso that said coagulant cannot be a cationic dispersion copolymer comprising about 30 mole % diallyldimethylammonium chloride (DADMAC) and about 70 mole % acrylamide (AcAm).

14 Claims, 4 Drawing Sheets

Polymers 4 lb/ton, Microparticle 2 lb/ton

Polymers 4 lb/ton, Microparticle 2 lb/ton

Polymers 4 lb/ton, Microparticle 4 lb/ton

Polymers 4 lb/ton, Microparticle 4 lb/ton

USE OF DIALLYLDIMETHYLAMMONIUM CHLORIDE ACRYLAMIDE DISPERSION COPOLYMER IN A PAPERMAKING PROCESS

CROSS-REFERENCE TO RELATED APPLICATIONS

This application is a continuation-in-part of U.S. patent application Ser. No. 09/172,587, filed Oct. 14, 1998, now abandoned; which is a continuation in part of U.S. patent application Ser. No. 08/845,795, filed Apr. 25, 1997, now abandoned; which is a continuation of U.S. patent application Ser. No. 08/641,671, filed May 1, 1996, now abandoned.

FIELD OF THE INVENTION

The present invention is in the technical field of papermaking. More specifically, this invention is in the technical field of wet-end additives to papermaking slurries.

BACKGROUND OF THE INVENTION

Retention and drainage are important properties of a papermaking process that papermakers are always seeking to optimize.

One method of improving the retention of cellulosic fines, mineral fillers and other furnish components on the fiber mat is the use of a coagulant/flocculant system, added ahead of the paper machine. To use such a system, a papermaking slurry (or furnish) is created out of a pulp. To this slurry is added a coagulant, with said coagulant being selected from the group consisting of low molecular weight cationic synthetic polymers, starch and alum. The coagulant generally reduces the negative surface charges present on the particles in the slurry, particularly cellulosic fines and mineral fillers, and thereby accomplishes a degree of agglomeration of such particles. The next item added is a flocculant. Flocculants typically are high molecular weight anionic synthetic polymers which bridge the particles and/or agglomerates, from one surface to another, binding the particles into large agglomerates. The presence of such large agglomerates in the slurry as the fiber mat of the paper sheet is being formed increases retention.

While a flocculated agglomerate usually does not interfere with the drainage of the fiber mat to the extent that would occur if the furnish were gelled or contained an amount of gelatinous material, there is a noticeable reduction in drainage efficiency when such flocculated agglomerates are filtered by the fiber web, because the pores thereof are to a degree reduced. Hence, retention usually is increased with some degree of deleterious effect on the drainage.

Another system employed to provide an improved combination of retention and drainage (or dewatering as it is sometime known) is described in U.S. Pat. Nos. 4,753,710 and 4,913,775, the disclosures of both of these patents being incorporated herein by reference. In brief, such method first adds to the aqueous cellulosic papermaking suspension a high molecular weight linear cationic polymer before shearing the suspension, followed by the addition of bentonite after shearing. The shearing generally is provided by one or more of the cleaning, mixing and pumping stages of the papermaking process. The shearing breaks down the large flocs formed by the high molecular weight polymer into microflocs. Further agglomeration then ensues with the addition of the bentonite clay particles.

Another system uses the combination of cationic starch followed by dispersed silica to increase the amount of material retained on the web by the method of charge neutralization and adsorption of smaller agglomerates. This system is described in U.S. Pat. No. 4,388,150, inventors Sunden et al., issued Jun. 14, 1983.

In another system, a high molecular weight cationic polymer is added to the slurry before shearing. Then an organic microparticle is added to the slurry after the introduction of shear. The organic microparticle is a medium molecular weight anionic polymer such as the copolymers of acrylic acid described in U.S. Pat. No. 5,098,520, the disclosure of which is incorporated herein by reference. Or the organic microparticle can be a medium molecular weight anionic sulfonated polymers such as those described in U.S. Pat. No. 5,185,062, the disclosure of which is herein incorporated by reference.

There continues to be a need to identify new additive or additives that when added in specific combinations result in improvement in retention and drainage in a papermaking process.

SUMMARY OF THE INVENTION

The claimed invention is:

in a papermaking process consisting essentially of:
- forming an aqueous cellulosic papermaking slurry;
- adding to the slurry certain additives, with said certain additives selected from the group including: coagulants; sizing agents; and mineral fillers;
- draining the slurry to form a sheet; and
- drying the sheet to form a paper sheet;
- the improvement comprising adding to the slurry, prior to it being drained; an effective amount of a cationic dispersion polymer; which cationic dispersion polymer is a copolymer comprising about 30 mole % diallyldimethylammonium chloride (DADMAC) and about 70 mole % acrylamide (AcAm); and
- adding to the slurry, either before or after said cationic dispersion polymer is added and the slurry is drained,
- a microparticle selected from the group consisting of
  - a) copolymers of acrylic acid and acrylamide;
  - b) bentonite; and
  - c) dispersed silica;

with the proviso that said coagulant cannot be a cationic dispersion copolymer comprising about 30 mole % diallyldimethylammonium chloride (DADMAC) and about 70 mole % acrylamide (AcAm).

DETAILED DESCRIPTION OF THE INVENTION

Figure 1:
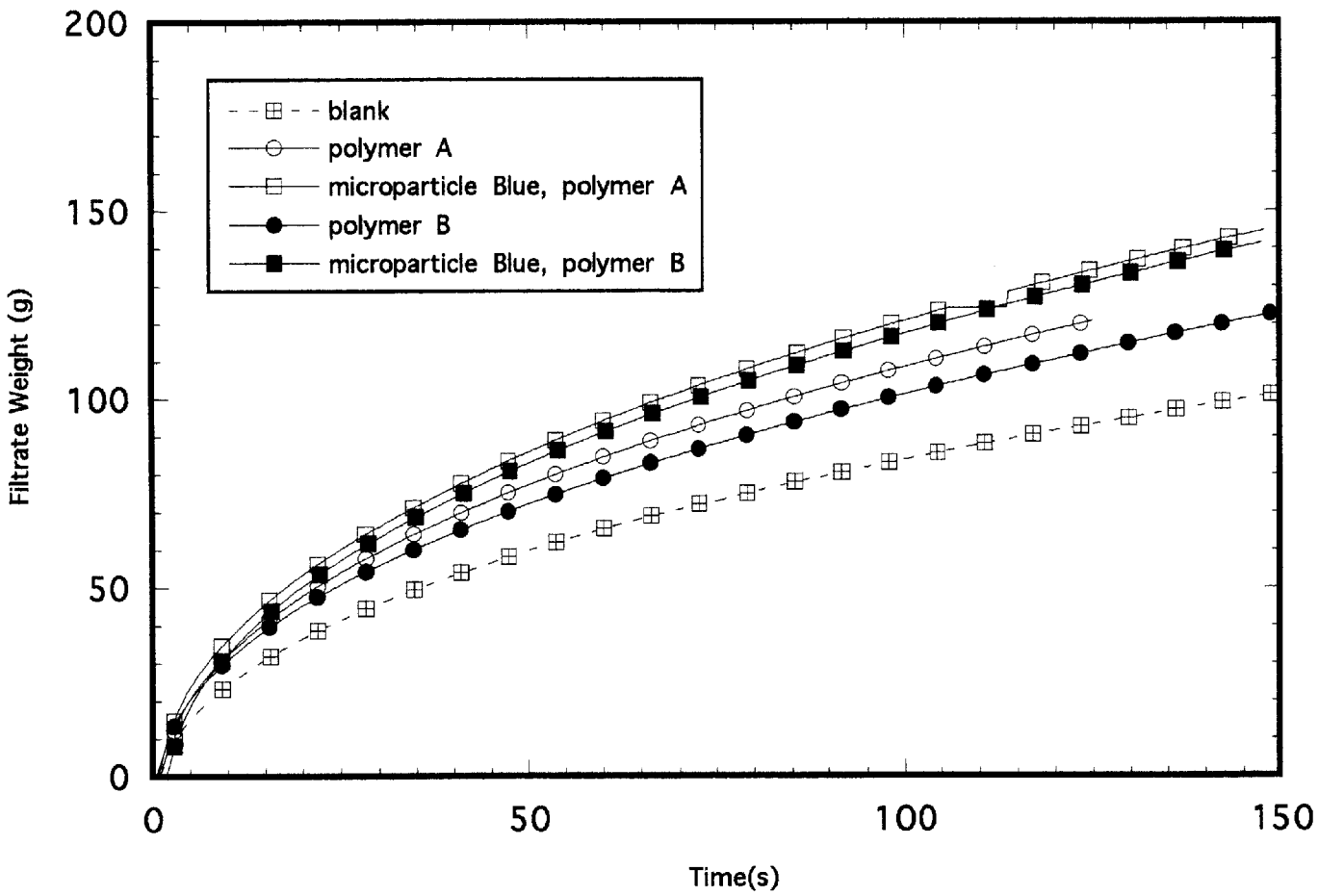
FIG. 1 is a plot of Filtrate Weight (in grams) vs. Time (in seconds) for tests results obtained with a TEST 2 slurry in which Polymer A and Polymer B are used with and without Microparticle Blue, as compared to test results obtained with a TEST 2 slurry without any polymer or microparticle being added. In this work, the microparticle was added to the slurry before the Polymer was added to the slurry.

Throughout this patent application, the following definitions will be used:

AcAm for acrylamide;

EDTA for ethylenediaminetetraacetic acid;

DADMAC for diallyldimethylammonium chloride; and

DMAEA.MCQ for dimethylaminoethyl acrylate.methyl chloride quaternary salt.

Latex (also known as "Water-in-Oil Inverse Suspension") Polymers—Polymers of this type are made by an inverse suspension polymerization using a hydrocarbon (oil) based continuous phase and various surfactants to provide emulsion stability. Polymerization occurs in aqueous monomer droplets suspended in oil. High molecular weight polymers such as flocculants can be prepared by this process. Prior to use, the product has to be converted to a water continuous solution through the use of another surfactant.

Solution Polymers—Polymers of this type are made by a polymerization process in which the reaction occurs in a solvent, usually water, wherein both the monomers and polymer are soluble. The viscosity of the final product is high and the resultant polymer is typically of low to medium molecular weight.

Dispersion Polymers are polymers that are made by a precipitation polymerization process which produces well defined particles, containing polymers of very high molecular weight. Polymerization occurs in a salt solution in which the monomers are soluble. The polymer is insoluble in the salt solution and precipitates as discrete particles. The particles are kept suspended using appropriate stabilizers. The final viscosity of the product is low, enabling ease of handling. There are no surfactants or oil present and the polymers are solubilized by simple mixing with water.

RSV stands for Reduced Specific Viscosity. Reduced Specific Viscosity is an indication of polymer chain length and average molecular weight. Polymer chain length and average molecular weight are indicative of the extent of polymerization during production. The RSV is measured at a given polymer concentration and temperature and calculated as follows:

$$RSV = \frac{[(\eta/\eta_o) - 1]}{c}$$

$\eta$=viscosity of polymer solution $\eta_o$=viscosity of solvent at the same temperature $\eta c$=concentration of polymer in solution.

In this patent application, the units of concentration "c" are (grams/100 ml or g/deciliter). Therefore, the units of RSV are dl/g. In this patent application, for measuring RSV, the solvent used was 1.0 Molar sodium nitrate solution. The polymer concentration in this solvent was 0.045 g/dl. The RSV was measured at 30° C. The viscosities $\eta$ and $\eta_o$ were measured using a Cannon Ubbelohde semimicro dilution viscometer, size 75. The viscometer is mounted in a perfectly vertical position in a constant temperature bath adjusted to 30±0.02° C. The error inherent in the calculation of RSV is about 2 dl/grams. When two polymers of the same composition have similar RSV's that is an indication that they have similar molecular weights.

IV stands for intrinsic viscosity, which is RSV when the limit of polymer concentration is zero.

According to the invention, the first step of the claimed invention is forming an aqueous cellulosic papermaking slurry. Specific cellulosic papermaking slurries are made out of specific papermaking pulps. The present process is believed applicable to all grades and types of paper products, and further applicable for use on all types of pulps including, without limitation, chemical pulps, including sulfate (a.k.a. kraft process pulps) and sulfite (a.k.a. acid process pulps) pulps from both hard and soft woods; thermo-mechanical pulps; mechanical pulps; recycle pulps and ground wood pulps. The preferred pulp employed is selected from the group consisting of chemical pulps and recycle pulps.

The pulp is used to make the aqueous cellulose slurry required to practice the instant claimed invention. Techniques useful to form an aqueous cellulosic papermaking slurry from a pulp are known in the art.

The next step is to add certain additives to the slurry. These selected additives include, but are not limited to, Coagulants;

Sizing agents (one or more), including, but not limited to, rosins; and

Mineral fillers (one or more).

Other additives may be incorporated based on the selection of pulp and desired grade of paper that is being made. The selection of the type of additives useful is within the purview of a person of ordinary skill in the art of papermaking and not all possible additives are included in each and every slurry.

Coagulants suitable for this purpose are those known to a person of ordinary skill in the art of papermaking, and include, but are not limited to starch; alum; and low molecular weight cationic synthetic polymers. Cationic or amphoteric starches useful as coagulants in this invention are generally described in U.S. Pat. No. 4,385,961, the disclosure of which is hereby incorporated by reference. Cationic starch materials are generally selected from the group consisting of naturally occurring polymers based on carbohydrates such as guar gum and starch. The cationic starch materials believed to be most useful in the practice of this invention include starch materials derived from wheat, potato and rice. These materials may in turn be reacted to substitute ammonium groups onto the starch backbone, or cationize in accordance with the process suggested by Dondeyne et al., in WO 96/30591. In general, starches useful in this invention have a degree of substitution (d.s.) of ammonium groups within the starch molecule between about 0.01 and about 0.05. The d.s. is obtained by reacting the base starch with either 3-chloro-2-hydroxypropyltrimethylammonium chloride or 2,3-epoxypropyltrimethylammonium chloride to obtain the cationized starch. It will be appreciated that it is beyond the scope and intent of this invention to describe means for the cationizing of starch materials and these modified starch materials are well known and are readily available from a variety of commercial sources.

Alum is commercially available and can be used as a coagulant in this instant claimed process.

There are low molecular weight cationic synthetic polymers that are known in the art as being capable of functioning as a coagulant in this process. One such cationic synthetic polymer is a solution polymer of epichlorohydrin-dimethylamine which is available from Nalco Chemical Company as Nalco® 7607. Other low molecular weight cationic synthetic polymers include poly diallyldimethylammonium chloride and polyethyleneimine; both of which are commercially available.

Sizing agents suitable to be used in this process, include, but are not limited to, rosins, and other materials that are known to a person of ordinary skill in the art of papermaking.

Mineral fillers are selected from the group consisting of titanium dioxide, clay, talc, calcium carbonate, and combinations thereof. The amount of mineral filler, such as calcium carbonate, generally employed in a papermaking slurry is from about 2 parts by weight of the filler, as $CaCO_3$, per hundred parts by weight of dry pulp in the slurry to about 50 parts by weight (on the same basis), preferably from about 5 parts by weight to about 40 parts by weight and most preferably from about 10 to about 30 parts by weight. One or more mineral fillers may be added to the slurry. The choice of and number of mineral fillers to be added is a decision that a person of ordinary skill in the art of papermaking can make, based upon the type of pulp selected and the final grade of paper desired.

The choice of and amount of certain additives to add to said slurry is dependent upon the pulp and the desired grade of paper to be made. Persons of ordinary skill in the art of papermaking are capable of selecting additives in order to make the desired grade of paper. For example a cationic potato starch can be used as a coagulant for an aqueous papermaking slurry containing a chemical pulp with an alkaline pH; whereas alum can be used as a coagulant for an aqueous papermaking slurry containing a chemical pulp with an acid pH.

Further details on the forming of aqueous cellulosic papermaking slurries can be found in any standard reference text in the art of papermaking. Once such text, is "PAPER BASICS: Forestry, Manufacture, Selection, Purchasing, Mathematics and Metrics, Recycling", by David Saltman, © 1978 by Van Norstrand Reinhold Company, published by Krieger Publishing Company, Krieger Drive, Malabar, Fla. 32950.

The next step in the process is to add to the slurry an effective amount of a cationic dispersion polymer which is a copolymer comprising about 30 mole % diallydimethyl ammonium chloride (DADMAC) and about 70 mole % acrylamide (AcAm).

A cationic dispersion polymer which is a copolymer comprising about 30 mole % diallyldimethyl ammonium chloride (DADMAC) and about 70 mole % acrylamide can be purchased from Nalco Chemical Company, One Nalco Center, Naperville, Ill. 60563 (630) 305–1000 as Nalco® 1470. The polymer is supplied in liquid form. The dose of polymer later recited is based on pounds of actual polymer, not pounds of liquid which contains polymer.

A cationic dispersion copolymer of about 30 mole % diallyldimethyl ammonium chloride (DADMAC) and about 70 mole % acrylamide can also be synthesized by following this procedure. To a two liter resin reactor equipped with stirrer, temperature controller, and water cooled condenser, is added 25.667 grams of a 40.0% solutions of acrylamide (0.1769 moles), 161.29 grams of a 62.0% solution of DADMAC (0.6192 moles), 200 grams of ammonium sulfate, 40 grams of sodium sulfate, 303.85 grams of deionized water, 0.38 grams of sodium formate, 45 grams of a 20% solution of poly(DMAEA.MCQ) (dimethylaminoethylacrylate methyl chloride quaternary salt, IV=2.0 dl/gm), and 0.2 grams of EDTA. The mixture is heated to 48° C. and 2.50 grams of a 4% solution of 2,2'-azobis(2-amidinopropane) dihydrochloride and 2.50 grams of a 4% solution of 2,2'-azobis(N,N'-dimethylene isobutryramidine) dihydrochloride is added. The resulting solution is sparged with 1000 cc/min of nitrogen. After 15 minutes, polymerization begins and the solution becomes viscous. Over the next 4 hours the temperature is maintained at 50° C. and a solution containing 178.42 grams of 49.0% acrylamide (1.230 moles) and 0.2 grams of EDTA is pumped into the reactor using a syringe pump. The resulting polymer dispersion has a Brookfield viscosity of about 4200 cps. The dispersion is then further reacted for 2.5 hours at a temperature of 55° C. The resulting polymer dispersion has a Brookfield viscosity of about 3300 cps. To the above dispersion is added 10 grams of 99% adipic acid, 10 grams of ammonium sulfate, and 12.5 grams of a 60% aqueous solution of ammonium thiosulfte. The resulting dispersion has a Brookfield viscosity of about 1312 cps and contains 20% of a 50 weight percent copolymer of acrylamide and DADMAC with an intrinsic viscosity of about 6.32 dl/gm in 1.0 molar $NaNO_3$.

Regarding what is an effective dosage of the cationic dispersion copolymer to add to the papermaking slurry, there does not appear to be a maximum dosage at which the amount of cationic dispersion copolymer present adversely affects the system. The dosage of cationic dispersion polymer is expressed in pounds of actual polymer per 2000 pounds of solids present in slurry. In this patent application the abbreviation for pounds of actual polymer per 2000 pounds of solids present in slurry is "lbs polymer/ton". Using those units, the amount of the cationic dispersion copolymer added is from about 0.02 lbs polymer/ton to about 20 lbs polymer/ton, preferably from about 1 lbs polymer/ton to about 15 lbs polymer/ton and most preferably, the amount of the cationic dispersion copolymer added is from about 1 lbs polymer/ton to about 4 lbs polymer/ton.

The cationic dispersion copolymer should become substantially dispersed within the slurry before formation of the paper product. In order to facilitate this dispersion, the cationic dispersion copolymer is typically added to the slurry dispersed in an aqueous medium.

During creation and processing of the slurry, the slurry is sheared because shearing is accomplished inherently during the unit operations of cleaning, mixing and pumping stages of the papermaking process.

The next step in the process is to add a microparticle selected from the group consisting of i) copolymers of acrylic acid and acrylamide;

ii) bentonite; and iii) dispersed silica,

Copolymers of acrylic acid and acrylamide useful as microparticles in this application include: a copolymer of acrylic acid and acrylamide sold under the trademark Nalco® 8677 PLUS, which is available from Nalco Chemical Company. Other copolymers of acrylic acid and acrylamide which can be used are described in U.S. Pat. No. 5,098,520, which is incorporated by reference.

Bentonites useful as the microparticle for this process include: any of the materials commercially referred to as bentonites or as bentonite-type clays, i.e., anionic swelling clays such as sepialite, attapulgite and montmorillonite. In addition to those listed, bentonites as described in U.S. Pat. No. 4,305,781 are suitable. The preferred bentonite is a hydrated suspension of powdered bentonite in water. Powdered bentonite is available as Nalbrite™, from Nalco Chemical Company.

Dispersed silicas useful in this application have an average particle size ranging between about 1–100 nanometers (nm), preferably having a particle size ranging between 2–25 nm, and most preferably having a particle size ranging between about 2–15 nm. This dispersed silica, may be in the form of colloidal, silicic acid, silica sols, fumed silica, agglomerated silicic acid, silica gels, precipitated silicas, and all materials described in Patent Cooperation Treaty Patent Application No. PCT/US98/19339 (WO 99/16708), published April of 1999; as long as the particle size or ultimate particle size is within the ranges mentioned above. Dispersed silica in water with a typical particle size of 4 nm is available as Nalco® 8671, from Nalco Chemical Company. Another type of dispersed silica, is a borosilicate in water; which is available as Nalco® 8692, from Nalco Chemical Company.

The dosage of microparticle is expressed in pounds of actual microparticle per 2000 pounds of solids present in slurry. In this patent application the abbreviation for pounds of actual microparticle per 2000 pounds of solids present in slurry is "lbs microparticle/ton". The amount of microparticle added is from about 0.05 lbs microparticle/ton to about 25.0 lbs microparticle/ton, preferably from about 1.5 lbs microparticle/ton to about 4.5 pounds microparticle/ton and most preferably about 2 pounds/ton.

It is possible to conduct the process of the instant claimed invention by adding the microparticle to the slurry either before or after the cationic dispersion polymer is added to the slurry. The choice of whether to add the microparticle before or after the polymer can be made by a person of ordinary skill in the art based on the requirements and specifications of the papermaking slurry.

The next step in the process is draining the slurry to form a sheet; and the final step in the process is drying the sheet to form a paper sheet. Both of these papermaking process steps are well known within the art of papermaking.

The conclusion reached, based on this work, is that the use of the cationic dispersion copolymer comprising about 30 mole % diallyldimethylammonium chloride (DADMAC) and about 70 mole % acrylamide (AcAm); with the above-described microparticles is effective in improving the retention and drainage of a papermaking process. In addition, the use of the cationic dispersion copolymer comprising about 30 mole % diallyldimethylammonium chloride (DADMAC) and about 70 mole % acrylamide (AcAm); with the above-described microparticles has been found to be more effective at improving the retention and drainage of a papermaking process than the use of a latex copolymer comprising about 30 mole % diallyldimethylammonium chloride (DADMAC) and about 70 mole % acrylamide (AcAm).

EXAMPLES

In all of these examples, terms used throughout have the following meanings. Polymers Polymer A is a cationic dispersion copolymer comprising about 30 mole % DADMAC and about 70 mole % AcAm (equivalent to about 50 weight % DADMAC and about 50 weight % AcAm) with a RSV of about 5.0 dl/g. Polymer A is available as Nalco®1470 from Nalco Chemical Company and can also be synthesized according to the method described herein.

Polymer B is a cationic latex copolymer comprising about 30 mole % DADMAC and about 70 mole % AcAm (equivalent to about 50 weight % DADMAC and about 50 weight % AcAm) with a RSV of about 4.99 dl/g. Polymer B is available as Nalco®7527 from Nalco Chemical Company.

Throughout this patent application, any data given for the use of Polymer B in the instant claimed process is to be considered a comparative example, not an example of the instant claimed process.

Microparticles

Microparticle Blue is a borosilicate in water; which is available as Nalco® 8692, from Nalco Chemical Company.

Microparticle Green is a hydrated suspension of powdered bentonite in water. Powdered bentonite is available as Nalbrite™ from Nalco Chemical Company.

Microparticle Red is a copolymer of acrylic acid and acrylamide; available as Nalco® 8677 PLUS from Nalco Chemical Company.

Coagulants

Coagulant Crow is a cationic potato starch, which is commercially available as Solvitose N™, from Nalco Chemical Company.

Coagulant Robin is a solution polymer of epichlorohydrin-dimethylamine; available as Nalco® 7607 from Nalco Chemical Company.

Example 1

The Retention Test

The Retention Test uses a Britt CF Dynamic Drainage Jar developed by K. W. Britt of New York State University. The Britt Jar generally consists of an upper chamber of about 1 liter capacity and a bottom drainage chamber, the chamber being separated by a support screen and a drainage screen. Below the drainage chamber is a downward extending flexible tube equipped with a clamp for closure. The upper chamber is provided with a variable speed, high torque motor equipped with a 2-inch 3-bladed propeller to create controlled shear conditions in the upper chamber. The test was conducted by placing the cellulosic slurry in the upper chamber and then subjecting the slurry to the following sequence:

| Time | Action |
|---|---|
| 0 seconds | Commence shear stirring at 750 rpm |
| 5 seconds | Add Coagulant |
| 10 seconds | Add Microparticle |
| 30 seconds | Add Polymer |
| 40 seconds | Start Draining |
| 70 seconds | Stop draining; measure filtrate turbidity |

The material so drained from the Britt jar (the "filtrate") is collected and diluted with water to one-fourth of its initial volume. The turbidity of such diluted filtrate, measured in Formazin Turbidity Units or FTU's, is then determined. The turbidity of such a filtrate is inversely proportional to the papermaking retention performance; the lower the turbidity value, the higher is the retention of filler and/or fines. The turbidity values were determined using a Hach Spectrophotometer, model DR2000.

The turbidity values (in FTU) that were determined were converted to (Percent Improvement) values using the formula:

$$\text{Percent Improvement}=100\times(\text{Turbidity}_u-\text{Turbidity}_t)/\text{Turbidity}_u$$

where $\text{Turbidity}_u$ is the turbidity reading result for the blank for which no polymer or microparticle, and wherein $\text{Turbidity}_t$ is the turbidity reading result of the test using polymer, or polymer and microparticle.

The cellulosic slurry used in these retention tests was TEST 1 Slurry: TEST 1 slurry is comprised solids which are made up of about 80 weight percent fiber and about 20 weight percent filler, diluted to an overall consistency of 0.5 percent with formulation water. The fiber was a 60/40 blend by weight of bleached hardwood kraft (sulfate chemical pulp) and bleached softwood kraft (sulfate chemical pulp), separately beaten to a Canadian Freeness value range of from 340 to 380 milliliters (mls).

To this slurry was added a mineral filler. The filler was a commercial calcium carbonate, provided in dry form. The formulation water contained 60 ppm calcium hardness (added as $CaCl_2$), 18 ppm magnesium hardness (added as $MgSO_4$) and 134 ppm bicarbonate alkalinity (added as $NaHCO_3$). The pH of the final thin stock (cellulosic slurry plus filler and other additives equals a "stock") was between about 7.5 and about 8.0.

A cellulosic slurry, hereinafter TEST 2 Slurry, was created as follows:

An offset grade of paper from a mid-western papermill was repulped in the lab to generate an acid test slurry with a solids content of about 0.5 weight percent. The composition of the solids in this slurry was about 40 weight % ground wood pulp, about 40 weight % chemical pulp, about 14 weight % broke and about 5 weight % fillers (talc and clay). The slurry was made at a pH of about 5.5; therefore, it is considered an acid test slurry.

TEST 2 Slurry was treated in the previously described Britt jar according to the following schedule:

TABLE I

Retention Test Results
Each Test used Coagulant Crow as the Coagulant at a dosage of 10 lbs Coagulant Crow per 2000 pounds of solids in slurry

| No. | Microparticle | Microparticle Dosage lbs microparticle/ ton | Polymer | Polymer Dosage lbs polymer/ ton | Turbidity (FTU) | Percent Improvement |
|---|---|---|---|---|---|---|
| i | blank | 0 | blank | 0 | 395 | not applicable |
| 1 | Blue | 2 | A | 4 | 124 | 68.6 |
| 2 | Blue | 4 | A | 4 | 95 | 75.9 |
| 3 | Blue | 2 | B | 4 | 156 | 60.5 |
| 4 | Blue | 4 | B | 4 | 117 | 70.4 |
| 5 | Green | 4 | A | 4 | 148 | 62.5 |
| 6 | Green | 4 | B | 4 | 171 | 56.7 |
| 7 | Red | 4 | A | 4 | 109 | 72.4 |
| 8 | Red | 4 | B | 4 | 120 | 69.6 |

Additional tests were conducted on the same slurry using a different coagulant. The of these tests are as follows.

TABLE II

Retention Test Results
Each Test used Coagulant Robin as the Coagulant at a dosage of 1 lb coagulant per 2000 pounds of solids in slurry

| No. | Microparticle | Microparticle Dosage lbs microparticle/ ton | Polymer | Polymer Dosage lbs polymer/ ton | Turbidity (FTU) | Percent Improvement |
|---|---|---|---|---|---|---|
| i | blank | 0 | blank | 0 | 395 | not applicable |
| 9 | Blue | 2 | A | 4 | 153 | 61.3 |
| 10 | Blue | 2 | B | 4 | 180 | 54.4 |

These results show that in a direct comparison of the dispersion polymer vs. the latex polymer; the dispersion polymer, when used together with the indicated microparticle, consistently showed a superior percent improvement. This result held true even when the coagulant present in the pulp was changed.

Example 2

The Drainage Test

The drainage test based on filtration measured the drainage (water removal) rate of the test slurry subjected to the various chemical treatments.

| Time | Action |
|---|---|
| 0 seconds | Commence shear stirring at 750 rpm |
| 5 seconds | Add Coagulant, which is Coagulant Crow at 24 lbs per ton of solids in slurry |
| 10 seconds | Add Microparticle (if microparticle is added before Polymer) |
| 20 seconds | Add Polymer |
| 25 seconds | Add Microparticle here (if mircoparticle was not added at 10 seconds) |
| 30 seconds | Stop mixing and transfer slurry to drainage set-up |

The treated slurry was transferred to a filtration cell which was mounted upright on a stand. The capacity of this cell is about 220 milliliters. A 200 mesh drainage screen (76 μm screen with 8% opening) served as the filter medium. The slurry was filtered by gravity. The filtrate was collected in a beaker placed on a weighing balance below the cell. This balance was interfaced with a computer so that the displayed weight was recorded continuously over time. The computer automatically recorded the change of weight over time. The rate of filtrate collection is an indication of the drainage performance; the higher the filtrate collection rate, the higher is the improvement in drainage.

TABLE III

Each Test Used Coagulant Crow as the Coagulant at a dosage of 24 pounds per 2000 pounds of solids in slurry

| Run | Microparticle | Dose lbs microparticle/ Ton | Polymer | Dose lbs Polymer/ ton | Microparticle | Dose lbs microparticle/ ton |
|---|---|---|---|---|---|---|
| 1 | — | — | — | — | — | — |
| 2 | — | — | A | 4 | — | — |
| 3 | — | — | B | 4 | — | — |
| 4 | blue | 2 | A | 4 | — | — |
| 5 | blue | 2 | B | 4 | — | — |
| 6 | — | — | A | 4 | blue | 2 |
| 7 | — | — | B | 4 | blue | 2 |
| 8 | green | 4 | A | 4 | — | — |
| 9 | green | 4 | B | 4 | — | — |
| 10 | — | — | A | 4 | green | 4 |
| 11 | — | — | B | 4 | green | 4 |

The data collected is illustrated in the Figures, in terms of rate of drainage. Rate of rainage is the filtrate weight collected per unit of time which is indicated by the slope of the line in each figure.

FIG. 1 shows a plot of data collected for Runs 1, 2, 3, 4 and 5. In FIG. 1, the filtration rate results show that the combination of Microparticle Blue and Polymer A, with the microparticle added to the paper slurry before the Polymer, outperformed any other combination—including Polymer A by itself, Polymer B by itself and Microparticle Blue and Polymer B together.

Figure 2:
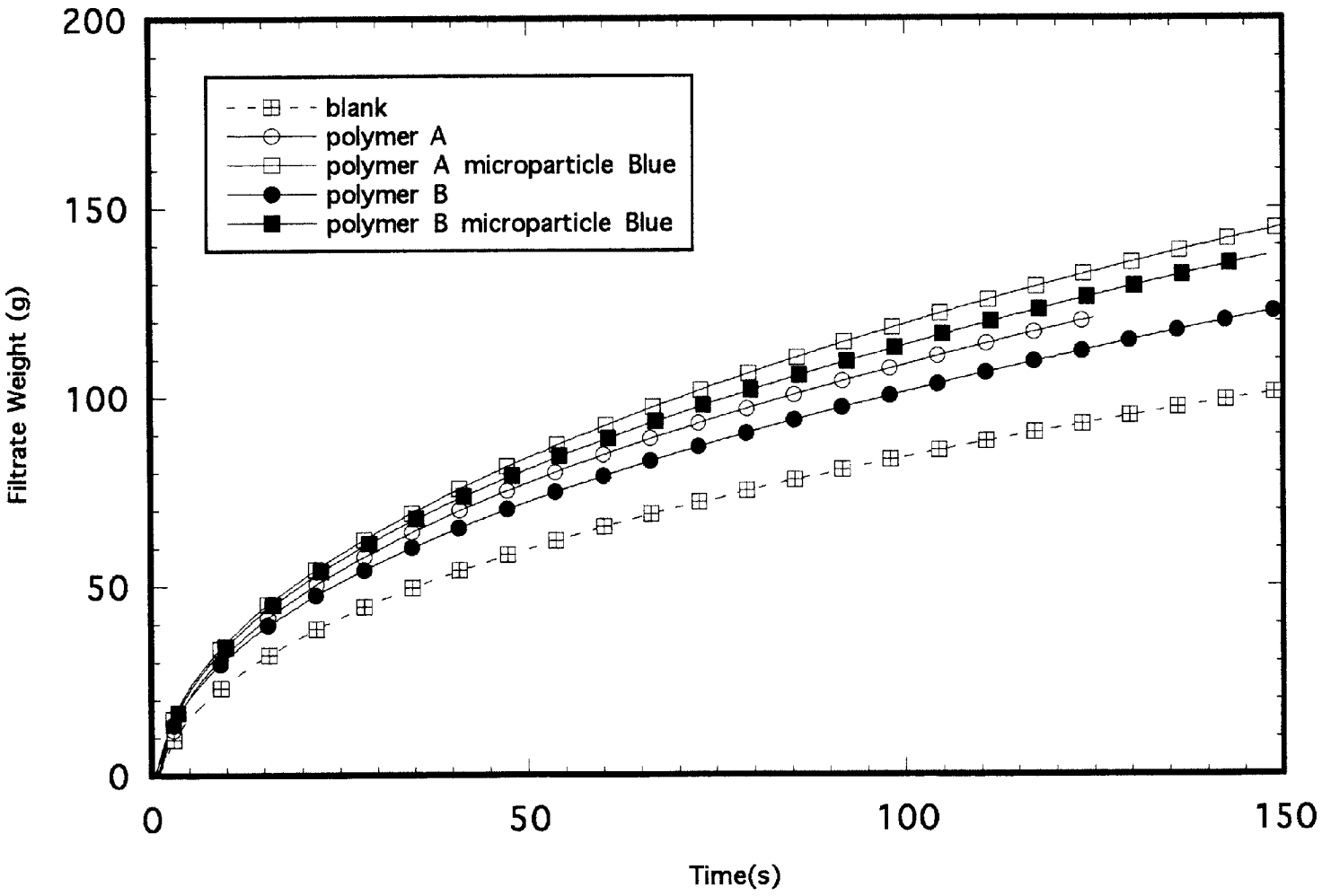
FIG. 2 is a plot of Filtrate Weight (in grams) vs. Time (in seconds) for tests results obtained with a TEST 2 slurry in which Polymer A and Polymer B are used with and without Microparticle Blue, as compared to test results obtained with a TEST 2 slurry without any polymer or microparticle being added. In this work, the microparticle was added to the slurry after the Polymer was added to the slurry.

FIG. 2 shows a plot of data collected for Runs 1, 2, 3, 6 and 7. In FIG. 2, the filtration rate results show that the combination of Polymer A and Microparticle Blue, with Polymer A added to the paper slurry before the Microparticle, outperformed any other combination—including Polymer A by itself, Polymer B by itself and Polymer B and Microparticle Blue together.

Figure 3:
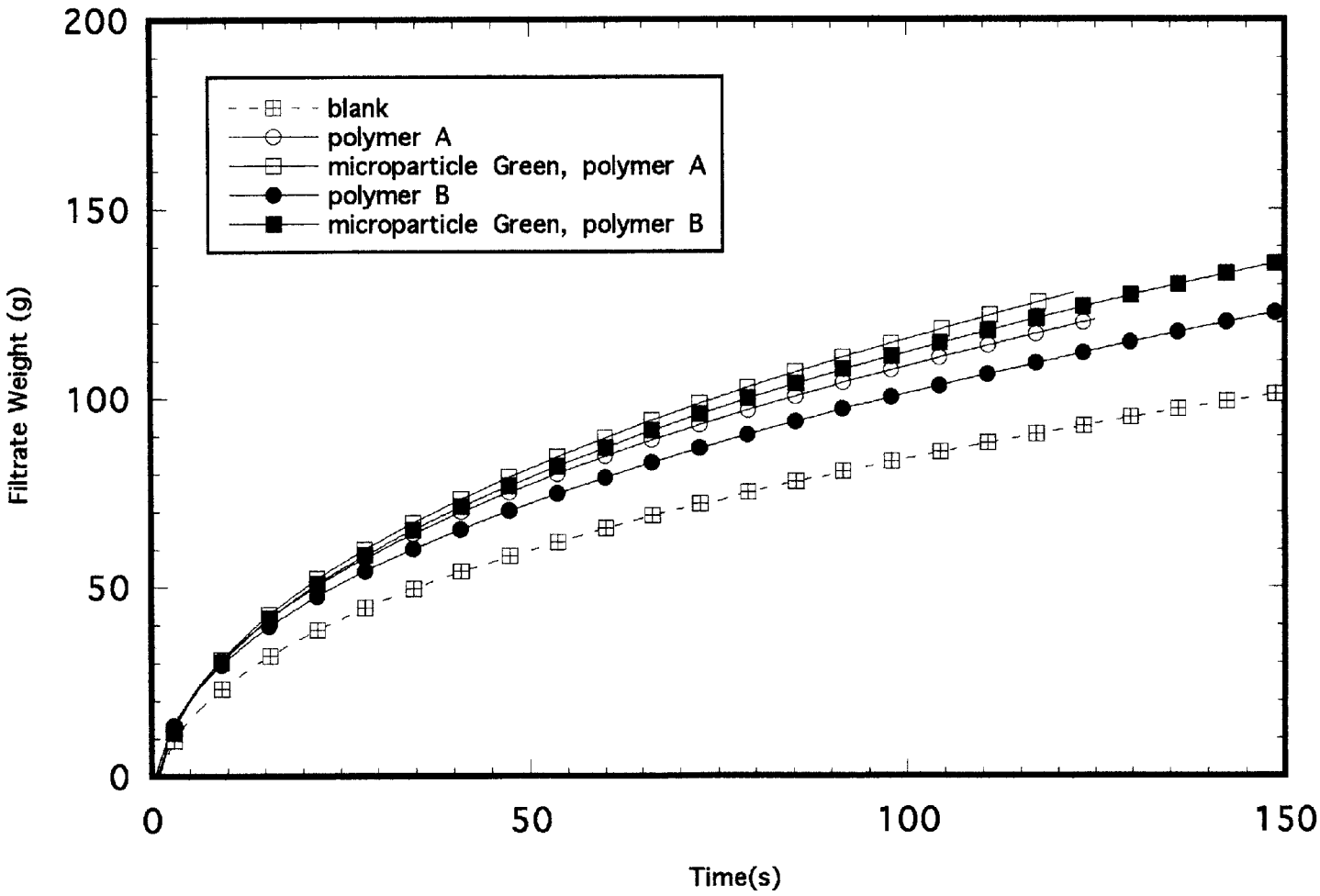
FIG. 3 is a plot of Filtrate Weight (in grams) vs. Time (in seconds) for tests results obtained with a TEST 2 slurry in which Polymer A and Polymer B are used with and without Microparticle Green, as compared to test results obtained with a TEST 2 slurry without any polymer or microparticle being added. In this work, the microparticle was added to the slurry before the Polymer was added to the slurry.

FIG. 3 shows a plot of data collected for Runs 1, 2, 3, 8 and 9. In FIG. 3, the filtration rate results show that the combination of Microparticle Green and Polymer A, with the Microparticle added to the paper slurry before the Polymer, outperformed any other combination—including Polymer A by itself, Polymer B by itself and Microparticle Green and Polymer B together.

Figure 4:
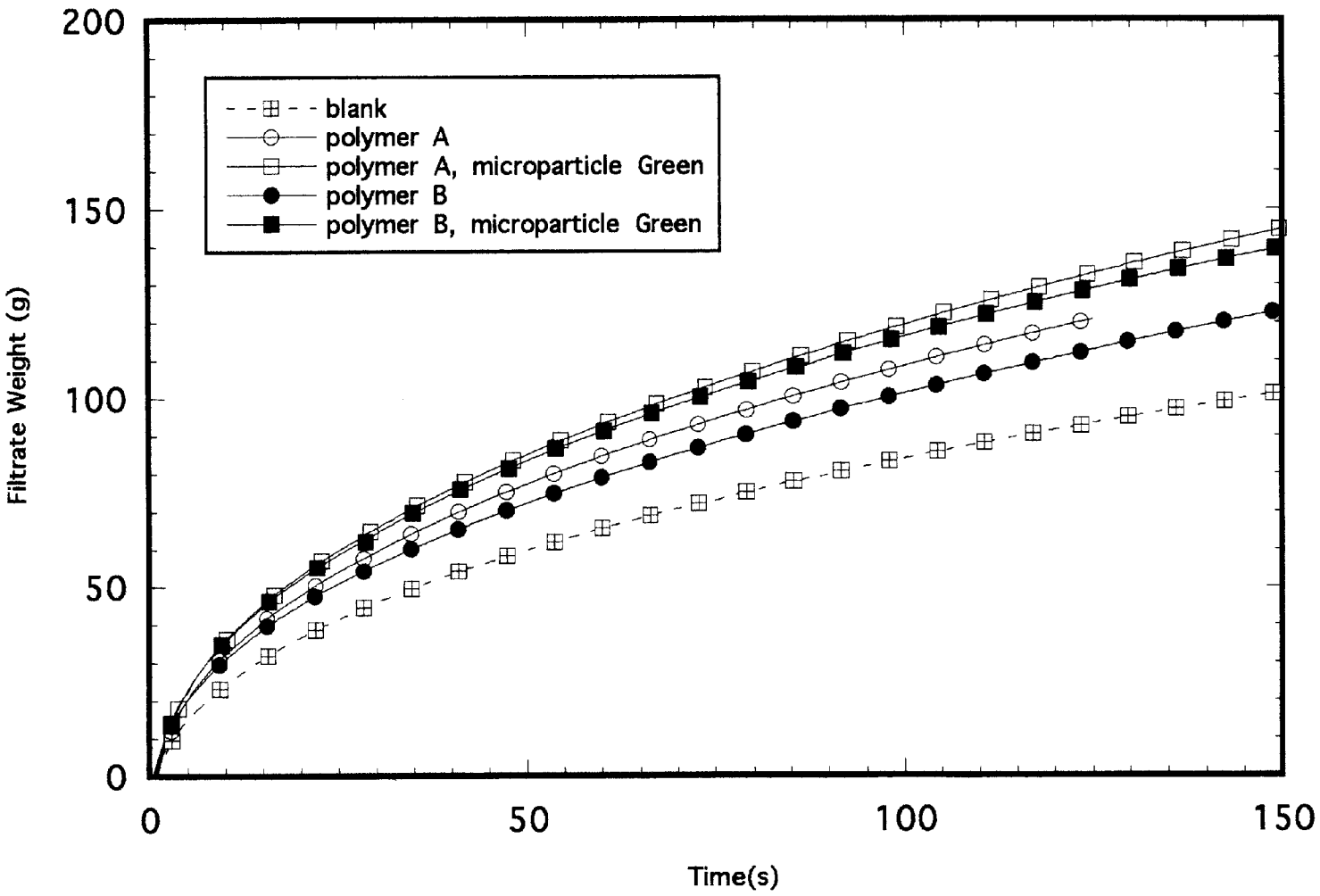
FIG. 4 is a plot of Filtrate Weight (in grams) vs. Time (in seconds) for tests results obtained with a TEST 2 slurry in which Polymer A and Polymer B are used with and without Microparticle Green, as compared to test results obtained with a TEST 2 slurry without any polymer or microparticle being added. In this work, the microparticle was added to the slurry after the Polymer was added to the slurry.

FIG. 4 shows a plot of data collected for Runs 1, 2, 3, 10 and 11. In FIG. 4, the filtration rate results show that the combination of Polymer A and Microparticle Green, with Polymer A added to the paper slurry before the Microparticle, outperformed any other combination—including Polymer A by itself, Polymer B by itself and Polymer B and Microparticle Green together.

Changes can be made in the composition, operation and arrangement of the method of the present invention described herein without departing from the concept and scope of the invention as defined in the following claims:

What is claimed is:

1. In a papermaking process consisting essentially of:

forming an aqueous cellulosic papermaking slurry;

adding to the slurry certain additives, with said certain additives selected from the group including: coagulants; sizing agents; and mineral fillers;

draining the slurry to form a sheet; and drying the sheet to form a paper sheet;

the improvement comprising adding to the slurry, prior to it being drained; from about 0.02 lbs polymer/ton to about 20 lbs polymer/ton of a cationic dispersion polymer; which cationic dispersion polymer is a copolymer comprising about 30 mole % diallyldimethylammonium chloride (DADMAC) and about 70 mole % acrylamide (AcAm); and dispersion polymer has an RSV of about 5.0 dl/g; and adding to the slurry, either before or after said cationic dispersion polymer is added and the slurry is drained, from about 0.05 lbs microparticle/ton to about 25.0 lbs microparticle/ton of a microparticle selected from the group consisting of a) copolymers of acrylic acid and acrylamide;

b) bentonite; and c) dispersed silica;

with the proviso that said coagulant cannot be a cationic dispersion copolymer comprising about 30 mole % diallyldimethylammonium chloride (DADMAC) and about 70 mole % acrylamide (AcAm).

2. The process of claim 1 wherein said microparticle is a copolymer of acrylic acid and acrylamide.

3. The process of claim 1 wherein said microparticle is bentonite.

4. The process of claim 1 wherein said microparticle is dispersed silica.

5. The process of claim 1 wherein said aqueous cellulose papermaking slurry comprises pulps which pulps are selected from the group consisting of chemical pulps; thermo-mechanical pulps; mechanical pulps; recycle pulps and ground wood pulps.

6. The process of claim 5 wherein said aqueous cellulose papermaking slurry comprises pulps which pulps are selected from the group consisting of chemical pulps and recycle pulps.

7. The process of claim 1 wherein one of said certain additives is a mineral filler wherein the mineral filler is selected from the group consisting of titanium dioxide, clay, talc, calcium carbonate and combinations thereof.

8. The process of claim 7 wherein said mineral filler is added to the slurry in an amount of from about 2 to about 50 parts per hundred parts by weight of dry pulp contained in the slurry.

9. The process of claim 1 in which one of said certain additives is a coagulant selected from the group consisting of starch; alum; and low molecular weight cationic synthetic polymers, wherein said low molecular weight cationic synthetic polymer is selected from the group consisting of epichlorohydrin-dimethylamine polymer, a poly diallyldimethylammonium chloride polymer and a polyethyleneimine polymer.

10. The process of claim 9 in which said coagulant is starch.

11. The process of claim 9 in which said coagulant is an epichlorohydrin-dimethylamine polymer.

12. The process of claim 1 in which said microparticle is added to the slurry after said polymer is added to the slurry.

13. The process of claim 1 in which said microparticle is added to the slurry before said polymer is added to the slurry.

14. The process according to claim 1 wherein said chemical pulps are selected from the group consisting of sulfate and sulfite pulps from both hard and soft woods.

* * * * *